US010875147B2

(12) United States Patent
Kim

(10) Patent No.: US 10,875,147 B2
(45) Date of Patent: Dec. 29, 2020

(54) GRINDING TOOL FIXTURE AND METHOD OF MANUFACTURING MAIN BODY OF GRINDING TOOL FIXTURE

(71) Applicant: E&Q One-Touch Co., Ltd., Ulsan (KR)

(72) Inventor: Chang Seong Kim, Ulsan (KR)

(73) Assignee: E&Q One-Touch Co., Ltd., Ulsan (KR)

( * ) Notice: Subject to any disclaimer, the term of this patent is extended or adjusted under 35 U.S.C. 154(b) by 318 days.

(21) Appl. No.: 15/826,242

(22) Filed: Nov. 29, 2017

(65) Prior Publication Data

US 2018/0117732 A1 May 3, 2018

Related U.S. Application Data

(63) Continuation of application No. PCT/KR2017/007859, filed on Jul. 21, 2017.

(30) Foreign Application Priority Data

Oct. 28, 2016 (KR) ..... 10-2016-0142393
Oct. 28, 2016 (KR) ..... 10-2016-0142394

(51) Int. Cl.
*B24B 23/02* (2006.01)
*B24B 45/00* (2006.01)
*B24B 41/04* (2006.01)

(52) U.S. Cl.
CPC ..... *B24B 41/04* (2013.01); *B24B 23/02* (2013.01); *B24B 23/022* (2013.01); *B24B 45/00* (2013.01); *B24B 45/006* (2013.01)

(58) Field of Classification Search
CPC ..... B24B 41/04; B24B 45/00; B24B 45/006; B24B 23/005; B24B 23/02; B24B 23/022
(Continued)

(56) References Cited

U.S. PATENT DOCUMENTS 1,736,972 A * 11/1929 Hutchinson ..... F16C 35/12 384/540
2,286,292 A * 6/1942 Mall ..... B24B 41/04 279/7

(Continued)

FOREIGN PATENT DOCUMENTS

EP 3 067 155 A1 9/2016
JP 2007-223022 A 9/2007

(Continued)

OTHER PUBLICATIONS

Office Action for Japanese Patent Application No. 2017-563121 dated Dec. 4, 2018; 3 pages.

*Primary Examiner* — Eileen P Morgan
(74) *Attorney, Agent, or Firm* — Brinks Gilson & Lione

(57) ABSTRACT

The present invention relates to a method of manufacturing a main body of a grinding tool fixture, a grinding tool fixture having a cap at a front, a sleeve and a coil spring consecutively connected, and a main body connected at a rear, and the main body having a body and a rotating shaft integrally formed with a rear of the body. The main body of the grinding tool fixture is turned, heat-treated, and then straightened. According to the present invention, a grinding tool for a grinder can be conveniently attached and detached by reciprocating a sleeve such that a separate working tool or fastener is not required, and the grinding tool can be immediately replaced even during use of the grinder.

1 Claim, 5 Drawing Sheets

(58) Field of Classification Search
USPC ..... 451/360
See application file for complete search history.

(56) References Cited

U.S. PATENT DOCUMENTS

| | | | | |
|---|---|---|---|---|
| 4,237,659 | A * | 12/1980 | Welsch | B24B 45/006 451/342 |
| 6,835,114 | B2 * | 12/2004 | Sjolander | B24B 3/33 454/342 |
| 6,939,213 | B2 * | 9/2005 | Lovchik | B23B 31/1071 279/7 |
| 2003/0153256 | A1 * | 8/2003 | Sjolander | B24D 7/18 451/541 |
| 2012/0051832 | A1 * | 3/2012 | Krause | B24D 13/20 403/27 |
| 2013/0180747 | A1 * | 7/2013 | Brown | B25F 5/00 173/145 |
| 2013/0193655 | A1 * | 8/2013 | Kaye, Jr. | B24B 45/006 279/141 |
| 2015/0306733 | A1 * | 10/2015 | Hesse | B24B 55/05 464/182 |
| 2017/0291277 | A1 * | 10/2017 | Gao | B24B 45/006 |
| 2018/0354040 | A1 * | 12/2018 | Cohn | B23B 31/086 |
| 2020/0223052 | A1 * | 7/2020 | Sabin | B24B 45/006 |

FOREIGN PATENT DOCUMENTS

| | | | |
|---|---|---|---|
| JP | 2008-049405 | A | 3/2008 |
| JP | 2013-056366 | A | 3/2013 |
| KR | 100813495 | B1 * | 3/2008 |
| KR | 100933038 | B1 * | 12/2009 |

* cited by examiner

GRINDING TOOL FIXTURE AND METHOD OF MANUFACTURING MAIN BODY OF GRINDING TOOL FIXTURE

CROSS-REFERENCE TO RELATED APPLICATIONS

This application is a continuation of International Application No. PCT/KR2017/007859, filed with the Korean Intellectual Property Office on Jul. 21, 2017, which claims priority to both Korean Patent Application No. 10-2016-0142393, filed on Oct. 28, 2016, and Korean Patent Application No. 10-2016-0142394, filed on Oct. 28, 2016, the entirely of all of which are incorporated by reference herein.

TECHNICAL FIELD

The present invention relates to a grinding tool fixture and a method of manufacturing a main body of the grinding tool fixture, and more particularly, to a grinding tool fixture and a method of manufacturing a main body of the grinding tool fixture in which a grinding tool for a grinder may be conveniently attached and detached to and from an insertion groove of a grinding tool fixture by reciprocating a sleeve, the grinding tool may be immediately replaced even during use of the grinder, and straightness is ensured such that precise processing is possible.

BACKGROUND

Generally, after first processing of parts for automobile, shipbuilding, or various industries, second processing is required for not sufficiently processed portions, rough surfaces, or before painting. It is common to use a grinding machine that rotates grindstone at a high speed and precisely polishes an object when some degree of preciseness is required and use a hand grinder that is lightweight and easy to use to polish an object when a part does not require much preciseness.

A general hand grinder operates a rotating shaft at a high speed by an air pressure generated during operation of an electric motor or a compressor and uses a grinding tool mounted at the rotating shaft to grind a surface of an object to be grinded formed of timber, stone, metal, and the like, thereby polishing or sharpening not sufficiently processed portions, corners, recessed portions, or the like and performing finishing work.

As related art, according to a grinding holder attachment/detachment structure of a hand grinder of Korean Utility Model Registration No. 20-0376952, there is disclosed a grinding holder attachment/detachment structure of a hand grinder including a grinding holder (11) in which an insertion rod (18) having a grinding material (10) for processing an object mounted at one side and a recessed groove (18a) at the other side is formed, a coupling (13) having a recessed groove (21) and a through-hole (22) for accommodating the insertion rod (18) of the grinding holder (11) and a screw hole (24) fastened to a rotating shaft (12a) of a grinder main body (12) consecutively formed at a rear end thereof, an elastic member (14) accommodated between the through-hole (22) and the screw hole (24) of the coupling (13) and configured to provide a reaction force when the grinding holder (11) is attached and detached, a sleeve (15) mounted at a circumferential surface of 15 the coupling (13) to be resiliently slidable, and a locking ball (16) disposed to lock and unlock the grinding holder (11) by being inserted into and withdrawn from the through-hole (22) formed at the center of the coupling (13) according to movement of the sleeve (15).

As another piece of related art, according to a device for attaching and detaching a grinding tool for a grinder of Korean Patent Registration No. 10-1056036, there is disclosed a device for attaching and detaching a grinding tool for a grinder, the device having a coupler mounted at a rotating shaft of a grinder main body and configured so that a grinding tool may be fixed and detached by sliding of a sleeve assembled to an outer circumferential surface of the coupler, the device including a grinding tool (11) having a grinding material (P1) mounted at one side of a body and a recessed groove (18a) disposed between a pair of flanges (17a, 17b) formed at a central portion of the other side, a coupler (12) having a seating hole (22a) into which the grinding tool (11) is fitted and fixed and a screw part (21b) including a through-hole (21a) and a locking step (21c) formed at a circumferential surface, a sleeve (13) disposed at the circumferential surface of the coupler (12), assembled to be resiliently slidable toward one side, and having a protruding piece (24) having an inclined surface (23a) and a step (23b) formed at an inner diameter part thereof, a locking ball (14) accommodated in the through-hole (21a) formed in the coupler (12) and configured to be inserted into and withdrawn from the recessed groove (18a) of the grinding tool (11) during movement of the sleeve (13) to fix and release the grinding tool (11), and a cap nut (16) fastened to a front end part of the coupler (12) and configured to regulate an assembling position of the sleeve (13), wherein an outer gear tooth part (18b) formed at a circumferential surface of a shaft extending toward a front end part at one side of the grinding tool (11) and an inner gear tooth part (22b) formed at an inner diameter part continuing from the seating hole (22a) of the coupler (12) are engaged with each other, the grinding tool (11) is separately formed of a first body (19A) having the grinding material (P1) and a second body (19B) having the outer gear tooth part (18b), and an axial rod (20b) formed at one end of the first body (19A) is configured to be bound to an insertion hole (20c) formed in the second body (19B).

However, in the above pieces of related art, a grinding tool for a grinder is attached and detached using a separate working tool or fastener, and there are disadvantages in that working time is delayed and vibration occurs during processing due to poor straightness of a main body of a grinding tool fixture.

TECHNICAL PROBLEM

Therefore, the present invention has been devised to solve the above problems, and an objective of the present invention is to provide a grinding tool fixture and a method of manufacturing a main body of the grinding tool fixture in which a grinding tool for a grinder may be conveniently attached and detached by reciprocating a sleeve such that a separate working tool or fastener is not required, the grinding tool may be immediately replaced even during use of the grinder, and straightness is ensured such that precise processing is possible.

TECHNICAL SOLUTION

The present invention relates to a method of manufacturing a main body of a grinding tool fixture, a grinding tool fixture (200) having a cap (30) at a front, a sleeve (40) and a coil spring (50) consecutively connected, and a main body (20) connected at a rear, and the main body (20) having a body (21) and a rotating shaft (22) integrally formed with a rear of the body (21).

The main body (20) of the grinding tool fixture (200) is turned, heat-treated, and then straightened.

ADVANTAGEOUS EFFECTS

Therefore, according to the present invention, a grinding tool for a grinder can be conveniently attached and detached by reciprocating a sleeve such that a separate working tool or fastener is not required, the grinding tool can be immediately replaced even during use of the grinder, and straightness is ensured such that precise processing is possible.

Figure 1:
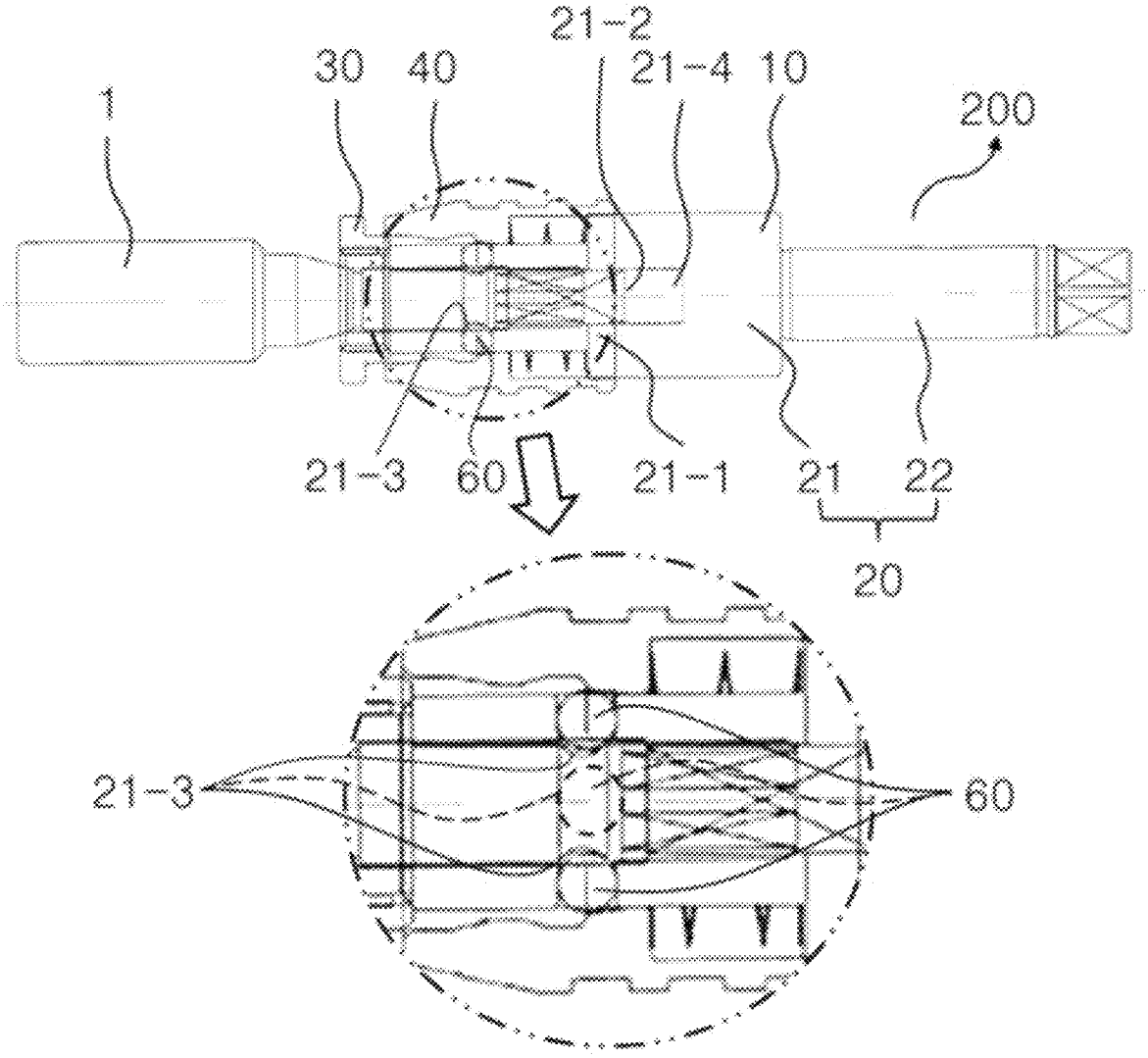
FIG. 1 is a cross-sectional view of a grinding tool fixture according to the present invention.

Detailed Description
<Description of reference numerals of main parts in the drawings>

| | |
|---|---|
| 1: Grinding tool | 1-1: Grinding material |
| 1-2: Grinding material holder | 1-2a: Front horizontal part |
| 1-2b: Inclined part | 1-2c: Step |
| 1-2d: Rear horizontal part | 1-2e: Circular groove |
| 1-2f: Quadrangular protrusion | 1-2g: Chamfer |
| 20: Main body | 21: Body |
| 21-1: Protrusion | 21-2: Insertion groove |
| 21-3: Bearing groove | 21-4: Quadrangular groove |
| 22: Rotating shaft | 30: Cap |
| 40: Sleeve | 50: Coil spring |
| 60: Bearing | |
| 200: Grinding tool fixture | |
| 100: Tool mounted at tool post for CNC lathe | |
| 110: Body | 111: Portion B (inner wall) of body |
| 112: Ring protrusion | 120: Fixing part |
| 130: Rotary body | 131: Processing tool |
| 132: Inclined surface | 133: Flat surface |
| 134: Wing part | 140: Hammer protrusion |
| 141: Spring | 142: Case |
| 143: Bolt | 151: Retainer |
| 152: Bearing | 152-1: Front bearing |
| 152-2: Central bearing | 152-3: Rear bearing |
| 153: Snap ring | 153-1: Front snap ring |
| 153-2: Rear snap ring | 154: Washer |

EMBODIMENTS

The present invention relates to a method of manufacturing a main body of a grinding tool fixture, a grinding tool fixture 200 having a cap 30 at a front, a sleeve 40 and a coil spring 50 consecutively connected, and a main body 20 connected at a rear, and the main body 20 having a body 21 and a rotating shaft 22 integrally formed with a rear of the body 21.

The main body 20 of the grinding tool fixture 200 is turned, heat-treated, and then straightened.

Further, after the straightening, turning is re-performed on an inclined part.

Further, a plurality of bearing grooves 21-3 are formed at an outer circumference of a front part of the body 21, a bearing 60 is inserted into the bearing groove 21-3 and fixes a grinding tool 1, a diameter of the bearing groove 21-3 is smaller than that of the bearing 60, the bearing 60 is unable to be detached from the bearing groove 21-3 toward a center of an inner diameter of the shaft and is detached out of the inner diameter of the shaft, and the coil spring 50 is installed between the sleeve 40 and the body 21 and pushes the sleeve 40 forward.

Further, the body 21 has a circular insertion groove 21-2 formed therein at a rear, a quadrangular groove 21-4 smaller than the insertion groove 21-2 extends from a rear surface of the insertion groove 21-2, and the body 21 and the rotating shaft 22 are integrally formed such that eccentricity does not occur during rotation, and quality of a processed product is improved.

Hereinafter, the present invention will be described in detail with reference to the accompanying drawings.

Figure 2:
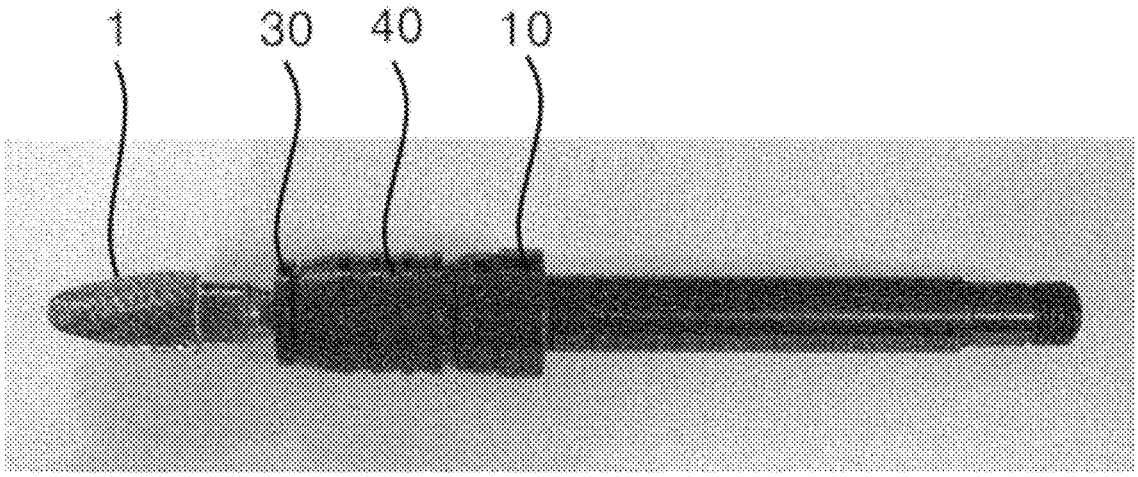
FIG. 2 is a photograph of a state in which a grinding tool is coupled to the grinding tool fixture according to the present invention.
Figure 3:
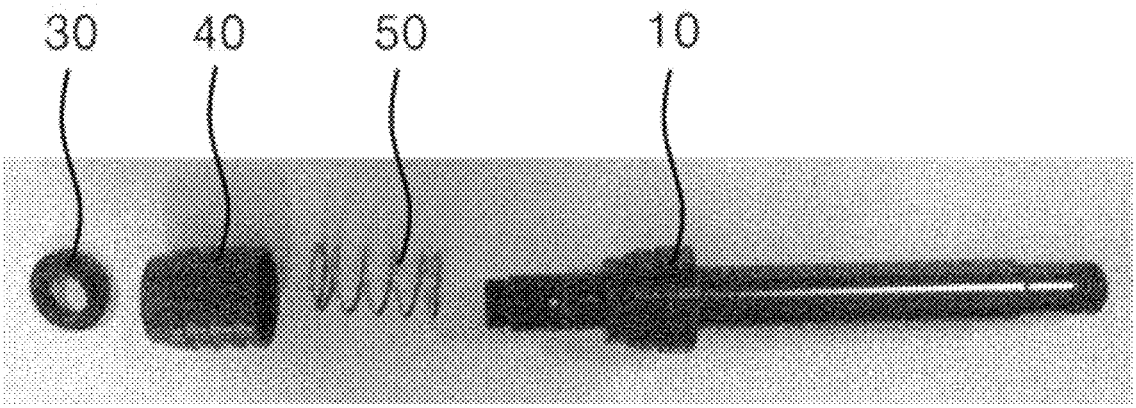
FIG. 3 is a photograph of an exploded state of the grinding tool fixture according to the present invention.
Figure 4:
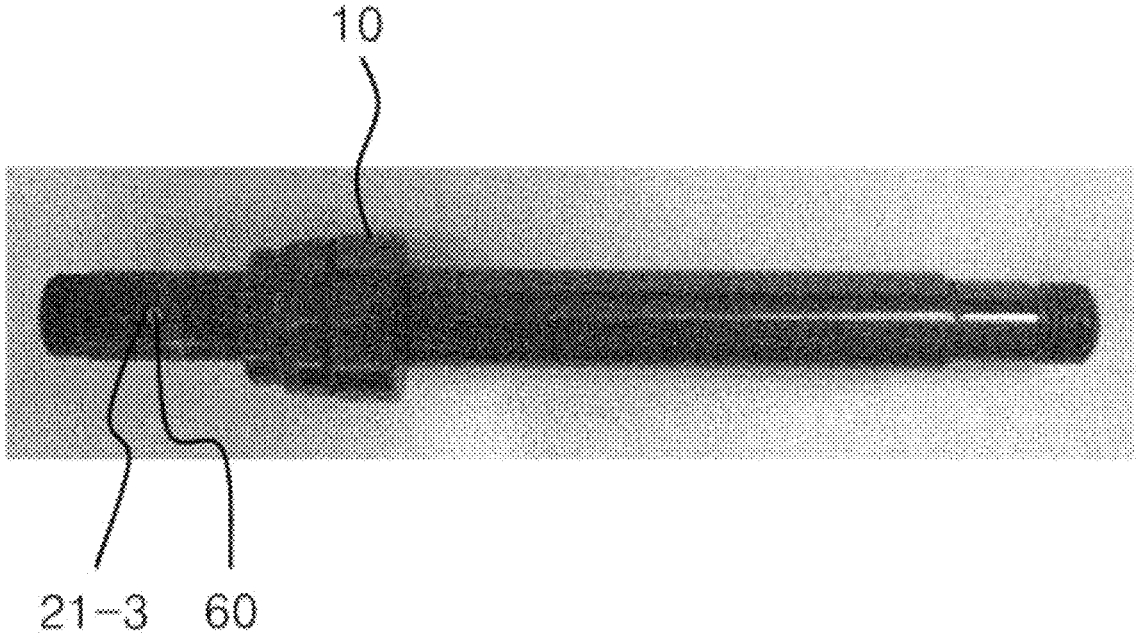
FIG. 4 is a photograph of a state in which a rotating shaft is integrally formed with a rear of the grinding tool fixture according to the present invention.
Figure 5:
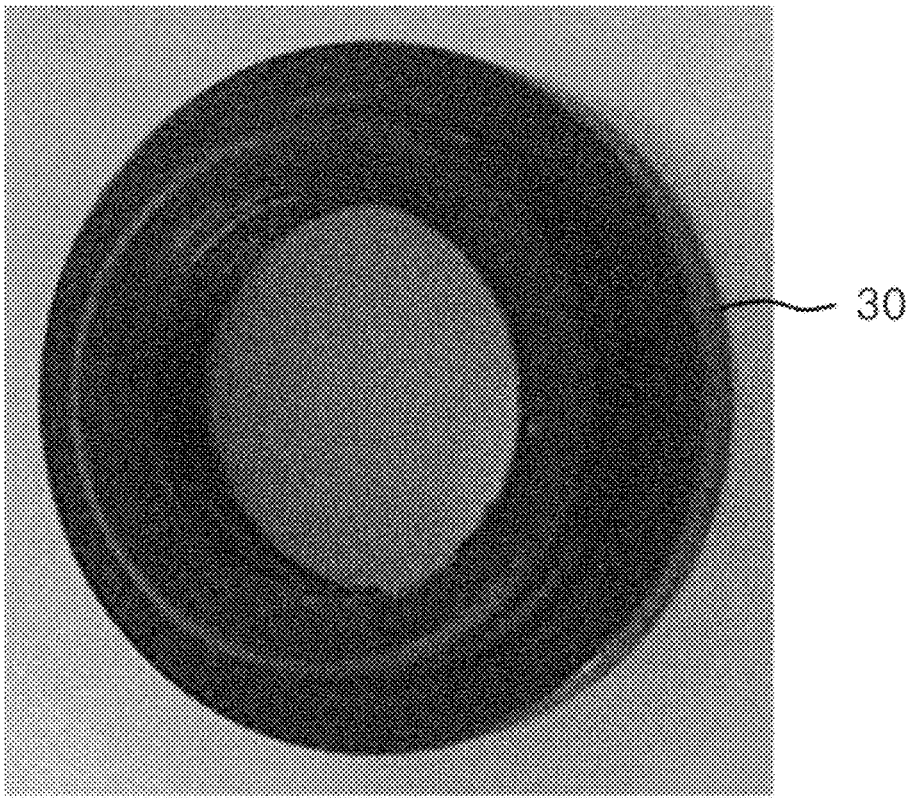
FIG. 5 is a photograph of a cap of the grinding tool fixture according to the present invention.
Figure 6:
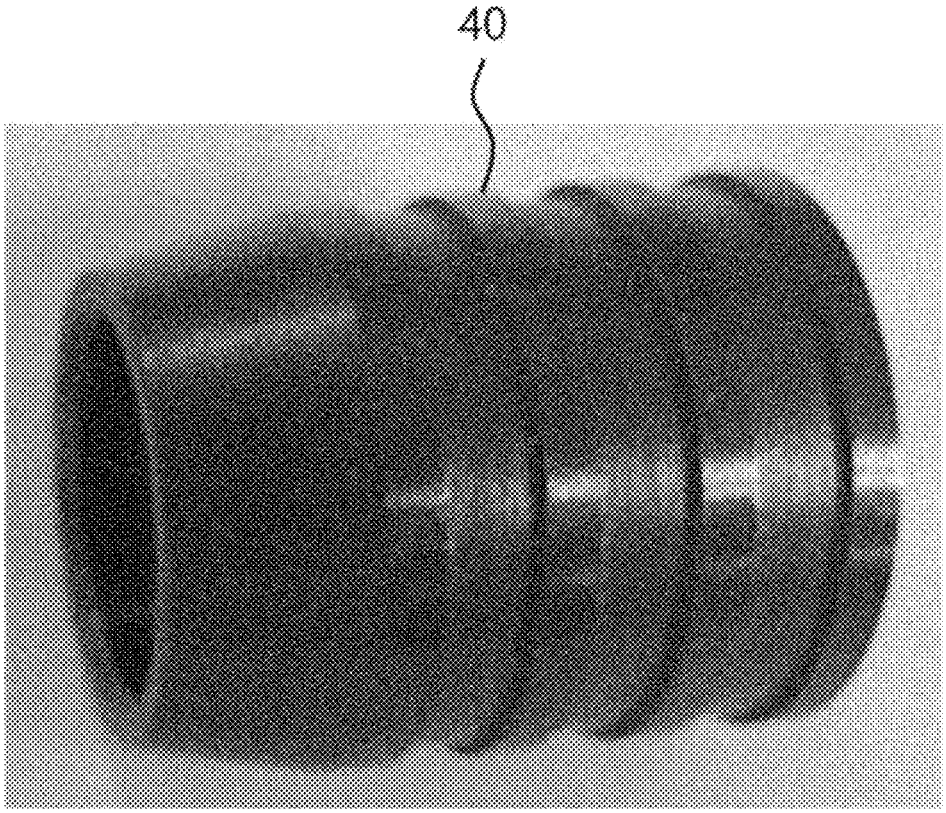
FIG. 6 is a photograph of a sleeve of the grinding tool fixture according to the present invention.
Figure 7:
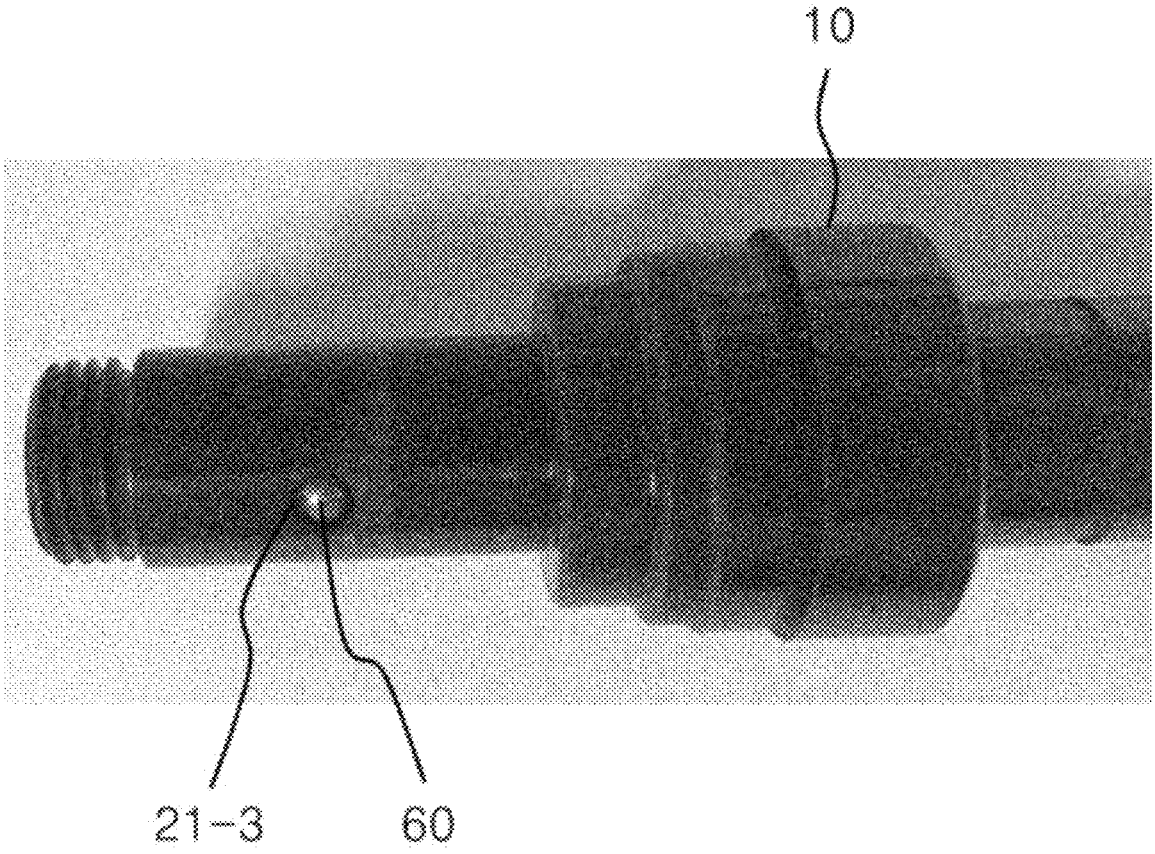
FIG. 7 is a photograph of a state in which a bearing is coupled to a bearing groove of the grinding tool fixture according to the present invention.
Figure 8:
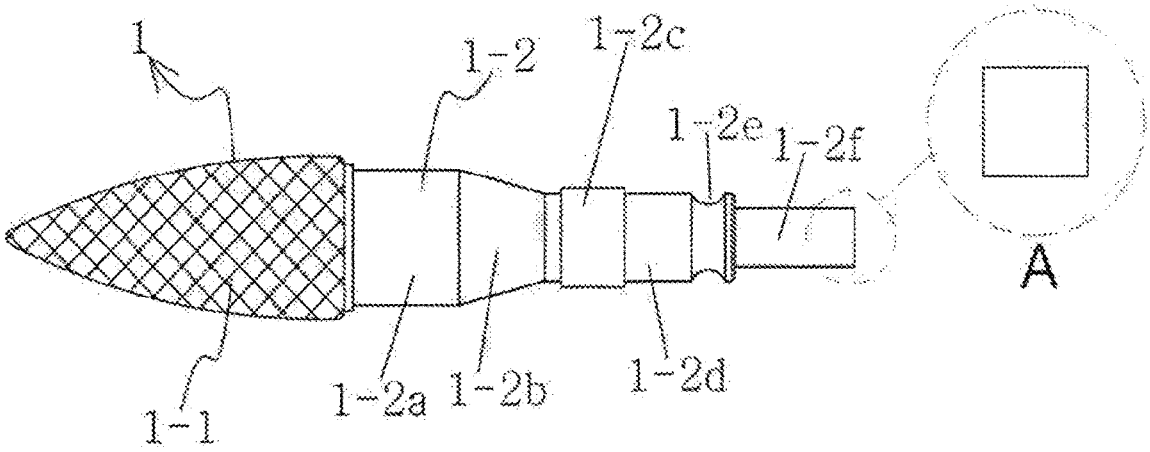
FIGS. 8 and 9 are detail views of a grinding tool according to the present invention (A and A' are detailed side views of a quadrangular protrusion).
Figure 9:
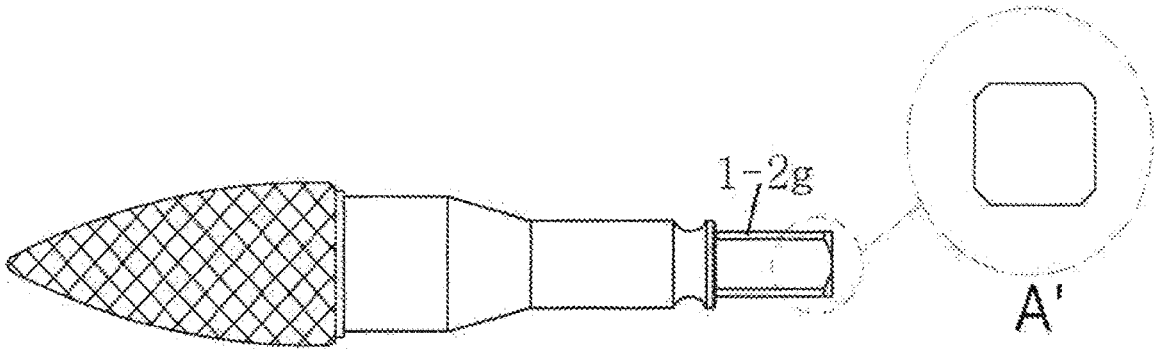

FIG. 1 is a cross-sectional view of a grinding tool fixture according to the present invention, FIG. 2 is a photograph of a state in which a grinding tool is 25 coupled to the grinding tool fixture according to the present invention, FIG. 3 is a photograph of an exploded state of the grinding tool fixture according to the present invention, FIG. 4 is a photograph of a state in which a rotating shaft is integrally formed with a rear of the grinding tool fixture according to the present invention, FIG. 5 is a photograph of a cap of the grinding tool fixture according to the present invention, FIG. 6 is a photograph of a sleeve of the grinding tool fixture according to the present invention, FIG. 7 is a photograph of a state in which a bearing is coupled to a bearing groove of the grinding tool fixture according to the present invention, and FIGS. 8 and 9 are detail views of a grinding tool according to the present invention.

Conventionally, when a grinding tool is fitted into a front portion, a manual tool is used to widen an inlet through which the grinding tool is inserted, and then the grinding tool is fixed and used. In the present invention, a sleeve of a grinding tool fixture is pulled backward, a grinding tool is inserted thereinto, and then the sleeve pulled backward is moved forward to fix the grinding tool.

As a method of detaching the grinding tool, the sleeve of the grinding tool fixture is pulled backward, the grinding tool is detached, and then the sleeve pulled backward is moved forward to detach the grinding tool.

Elements of the grinding tool fixture 200 include the cap 30 at the front, the sleeve 40 and the coil spring 50 consecutively connected, and the main body 20 connected at the rear, and the main body 20 includes the body 21 and the rotating shaft 22 formed at the rear of the body 21

The cap, the sleeve, and the main body are formed of a chrome molybdenum steel (SCM) material, and SCM 415 material is mainly used.

The cap 30 has a hole formed at a center and is manufactured in two stages such that a step is formed and a diameter is gradually smaller toward a rear end.

The rear end of the cap 30 is inserted into the sleeve 40 therebehind, a screw part whose diameter is equal to an inner diameter of the cap 30 is formed, and the screw part is coupled to a front end of the body protruding forward inside the sleeve 40.

The sleeve is coupled to the rear of the cap, wherein the sleeve is formed in a cylindrical shape and has a groove formed at an outer circumference thereof to be easily grasped.

The sleeve is formed such that an inner diameter thereof is smaller at the rear than the front and allows a front end of the coil spring 50 to be seated.

The body 21 has a front end disposed inside the sleeve and a protrusion 21-1 formed at a middle, wherein the protrusion is formed to have a larger diameter than that of the front end of the body.

A rear end of the rotating shaft 22 formed behind the body 21 has a screw part formed thereat and is coupled to the grinder.

Further, instead of the screw part formed at the rear end of the rotating shaft, the rotating shaft may be formed in a polygonal shape and coupled to the grinder.

The body has the circular insertion groove 21-2 formed therein at the rear.

A portion in which the insertion groove is formed is up to a front end of the protrusion.

The quadrangular groove 21-4 in the quadrangular shape further extends from the rear end of the insertion groove, and a quadrangular shape at an end of the grinding tool is coupled to the quadrangular groove.

The quadrangular groove is formed to be smaller than the insertion groove.

A front portion of the body 21 has three bearing grooves 21-3 formed at an outer circumference thereof, and the bearing 60 is inserted into the three bearing grooves 21-3 to fix the grinding tool 1.

A ball bearing is used as the bearing.

Because a diameter of the bearing groove is smaller than that of the bearing, the bearing is unable to be detached from the bearing groove toward a center of an inner diameter of the shaft and may only be detached out of the inner diameter of the shaft.

The coil spring is installed between the sleeve and the body.

The coil spring 50 is installed between a rear portion of the inner diameter of the sleeve and a front portion of the protrusion of the body to always push the sleeve forward.

The body 21 has the bearing inserted into an outer circumferential surface thereof, and the bearing fixes the grinding tool. Three bearings are appropriate.

Therefore, the grinding tool is mounted at the front end of the grinding tool fixture, and the rear end of the grinding tool is processed to have a quadrangular cross-section so that the quadrangular portion is coupled to the quadrangular groove of the grinding tool fixture and rotates.

More specifically, the grinding tool includes a grinding material 1-1 and a grinding material holder 1-2 formed at a rear end of the grinding material.

The grinding material holder includes a front horizontal part 1-2*a*, an inclined part 1-2*b*, a step 1-2*c*, a rear horizontal part 1-2*d*, a circular groove 1-2*e*, and a quadrangular protrusion 1-2*f* consecutively formed from the front toward the rear.

The front horizontal part 1-2*a* has a cylindrical shape, the inclined part 1-2*b* is formed behind the front horizontal part 1-2*a*, and the inclined part 1-2*b* is formed to have a diameter gradually increasing from the rear toward the front.

The step 1-2*c* is formed behind the inclined part 1-2*b*, the rear horizontal part 1-2*d* is formed behind the step 1-2*c*, and the rear horizontal part 1-2*d* is formed to have a smaller diameter than that of the front horizontal part 1-2*a*.

The circular groove 1-2*e* is formed behind the rear horizontal part 1-2*d*. The circular groove 1-2*e* is formed along the outer circumference of the grinding material holder 1-2, and the grinding tool 1 is coupled or detached when a force is applied to the circular groove 1-2*e* from the bearing of the grinding tool fixture 200.

The quadrangular protrusion 1-2*f* processed to have a quadrangular cross-section is formed behind the circular groove 1-2*e*.

A chamfer 1-2*g* is formed at each corner of the quadrangular protrusion 1-2*f* for the quadrangular protrusion 1-2*f* to be easily coupled to the quadrangular groove 21-4 of the grinding tool fixture 200.

Because the inclined part 1-2*b* of the grinding material holder 1-2 and the ring-shaped step are formed at corresponding positions in the body, eccentricity does not occur when the grinding material holder 1-2 is coupled to the grinding tool fixer.

The cap 30, the sleeve 40, and the main body 20 of the grinding tool fixture 200 of the present invention are turned on a computer numerical control (CNC) lathe and are carburized and heat-treated.

Particularly, a method of processing a main body 20 of the grinding tool fixer, which is the technical gist of the present invention, will be described in detail.

The main body 20 of the grinding tool fixer is processed by turning a material thereof according to a shape shown in FIG. 4.

In processing the quadrangular groove 21-4 of the body, the circular groove 1-2*e* is processed first, and then the quadrangular groove 21-4 is processed. The circular groove 1-2*e* is circularly drilled first, and when a length of one side of a quadrangular cross-section of the quadrangular groove 21-4 is 5.1 mm, drilling is performed so that a diameter is 5 mm smaller. Then, the quadrangular groove 21-4 is processed. Because the quadrangular protrusion 1-2*f* of the grinding material holder 1-2 coupled to the quadrangular groove 21-4 has the chamfer formed at each of the corners, the quadrangular protrusion 1-2*f* is easily coupled to the quadrangular groove 21-4. Here, a diagonal length of the quadrangular groove 21-4 is about 6.1 mm.

Here, a gap of about 0.2 mm is formed between an end of the quadrangular protrusion 1-2*f* of the grinding material holder 1-2 and a bottom surface of the quadrangular groove 21-4.

Then, a hole is processed using a drill and an end mill.

Then, a heat treatment step is performed. A carburized heat treatment method is used for the heat treatment so that a hardness of HRC55 is achieved. The carburizing temperature is in the range of 830 to 850° C. The carburizing time is about 3 hours 20 minutes to 3 hours 40 minutes.

Then, straightening is performed. The main body 20 that is bent like a bow due to being heat treated is put in a straightening mold and pressed to be straightened such that a straightness tolerance is within 5/100.

Because deformation occurs after the heat treatment, the inclined part 1-2*b* is separately grinded after the heat treatment. This is to compensate for straightness.

Here, the CNC lathe uses an outer diameter collet chuck exclusive therefor, and an inclined surface of a corresponding tool also accurately corresponds to a predetermined angle, 15°.

In the present invention, the inclined part 1-2*b* of the grinding material holder 1-2 and the ring-shaped step are formed at corresponding positions. Therefore, after straightness of the quadrangular groove 21-4 of the body is determined, the inclined angle is set as 15° when the straightness tolerance is within the predetermined tolerance, 5/100, and the inclined angle is set to be smaller than 15° to compensate for the straightness when the straightness tolerance deviates from the predetermined tolerance, 5/100, and increases. When the inclined angle becomes smaller than 15°, a length tolerance increases when a front end of a tool is worn out, and a service life of the tool increases.

Because the inclined angle of the front end of the tool may be set to be large, the length tolerance decreases even when the front end of the tool is worn out, and the service life of the tool increases.

What is claimed is:

1. A grinding tool fixture for fixing a grinding tool processing a surface of an object to be processed to a hand grinder, wherein:

the grinding tool includes a grinding material processing the surface of the object to be processed and a spindle inserted to the grinding tool fixture, the spindle includes a first axis part, an inclined part, a step, a second axis part, a circular groove, and a quadrangular protrusion consecutively formed from a first end toward a second end of the spindle, the first axis part includes a cylindrical shape, the inclined part is formed to have a diameter that is gradually smaller toward the second end of the spindle, the second axis part includes a cylindrical shape and is formed to have a smaller diameter than that of the first axis part, and the circular groove is formed along a circumference of the second axis part, the grinding tool fixture includes a main body mounted at a rotating shaft of the hand grinder, a sleeve connected to a first end of the main body, a spring installed between the main body and the sleeve, and a cap connected to a first end of the sleeve, a circular insertion groove to which the spindle is inserted is formed inside a body, and a quadrangular groove to which the quadrangular protrusion is inserted is formed at a second end of the insertion groove, three bearing grooves are radially formed at an outer circumference of a first end of the body that is inserted to the sleeve, and a bearing for fixing and releasing the grinding tool is inserted to the bearing grooves, when the sleeve moves toward the cap in a state that the grinding tool is installed at the grinding tool fixture, the sleeve makes the bearing move to be inserted to the circular groove and thus the grinding tool is fixed, and when the sleeve moves toward the main body in a state that the grinding tool is fixed, a state pressed by the bearing is released, the bearing is deviated from the circular groove, and thus the grinding tool is released.

* * * * *